United States Patent [19]

Heard

[11] Patent Number: 4,753,053

[45] Date of Patent: Jun. 28, 1988

[54] ANCHOR FOR EROSION RESISTANT REFRACTORY LINING

[75] Inventor: Nolan E. Heard, Houston, Tex.

[73] Assignee: Robert J. Jenkins, Webster, Tex. ; a part interest

[21] Appl. No.: 98,770

[22] Filed: Sep. 17, 1987

Related U.S. Application Data

[63] Continuation of Ser. No. 803,506, Nov. 29, 1985, abandoned, which is a continuation of Ser. No. 560,535, Dec. 12, 1983, abandoned.

[51] Int. Cl.[4] ..... E04B 1/38

[52] U.S. Cl. ..... 52/712; 52/334; 52/378; 52/513; 110/336

[58] Field of Search ..... 52/122.1, 125.1, 125.2, 52/125.4, 125.5, 245, 249, 269, 278, 333, 334, 348, 353, 357–365, 370, 383, 385, 410, 449, 478, 479, 484, 506, 509, 512, 513, 687, 698, 699, 712–715; 110/336; 269/53

[56] References Cited

U.S. PATENT DOCUMENTS

| | | | |
|---|---|---|---|
| 1,082,470 | 12/1913 | Phelan | 52/715 |
| 1,373,266 | 3/1921 | Smith | 52/687 |
| 1,562,784 | 11/1925 | Olsen | 52/370 |
| 1,626,589 | 5/1927 | Alser | 52/367 |
| 1,846,383 | 2/1932 | Campbell | 52/353 |
| 1,883,540 | 10/1932 | Campbell | 52/357 |
| 1,928,313 | 9/1933 | Gaylord, Jr. | 52/378 |
| 1,945,925 | 2/1934 | Stiefel | 52/714 |
| 2,042,438 | 5/1936 | Wells | 52/333 |
| 2,173,094 | 9/1939 | Burson | 52/353 |
| 2,237,777 | 4/1941 | Burson | 52/715 |
| 2,340,176 | 1/1944 | Cueni et al. | 52/334 |
| 2,918,814 | 12/1959 | Farina | 52/513 |
| 3,076,481 | 2/1963 | Wygant | 52/269 |
| 3,077,058 | 2/1963 | Hensel | 52/378 |
| 3,270,472 | 9/1966 | Gilbert | 52/348 |
| 3,336,712 | 8/1967 | Bartley | 52/378 |
| 3,564,799 | 2/1971 | Hanson | 52/334 |
| 3,587,198 | 6/1971 | Hensel | 52/741 |
| 3,590,546 | 7/1971 | Lambert | 52/475 |
| 4,018,020 | 4/1977 | Sauer et al. | 52/278 |
| 4,437,272 | 3/1984 | Johnson | 52/125.5 |
| 4,440,099 | 4/1984 | Brachet et al. | 110/336 |
| 4,479,337 | 10/1984 | Crowley | 52/378 |

FOREIGN PATENT DOCUMENTS

| | | | |
|---|---|---|---|
| 2348684 | 4/1974 | Fed. Rep. of Germany | 52/712 |
| 2737634 | 3/1979 | Fed. Rep. of Germany | 52/513 |
| 1079053 | 11/1954 | France | 52/687 |
| 753003 | 7/1956 | United Kingdom | 52/269 |
| 1162476 | 8/1969 | United Kingdom | 52/125.5 |

OTHER PUBLICATIONS

"Equation Helps Select Refractory Anchor System", by M. S. Crowley, Oil & Gas Journal, Aug. 30, 1982.

*Primary Examiner*—John E. Murtagh
*Assistant Examiner*—Andrew Joseph Rudy
*Attorney, Agent, or Firm*—Pravel, Gambrell, Hewitt, Kimball & Krieger

[57] ABSTRACT

A support anchor is provided for anchoring a castable or plastic refractory material to a processing vessel wall. The support anchor of the present invention includes a flat center member portion and portions integrally formed with and extending transversely with respect to each end of the center member. Attachment members are formed at an inner edge of the support body so that the support body is mounted at a spaced position from the vessel wall. Plural openings are formed in the support body to allow flow of refractory material during installation to aid in at least partial bonding of the installed refractory and the support anchor. Anchoring members are mounted adjacent the openings in the support body to provide anchoring support submerged within the installed refractory material.

9 Claims, 1 Drawing Sheet

ANCHOR FOR EROSION RESISTANT REFRACTORY LINING

SPECIFICATION

This is a continuation of applicaiton Ser. No. 803,506 filed on Nov. 29, 1985 now abandoned which was a continuation of Ser. No. 560,535 filed Dec. 12, 1983 now abandoned.

FIELD OF THE INVENTION

The present invention relates to anchor supports for pourable, such as concrete, linings and particularly anchor supports for refractory linings of high temperature processing equipment.

DESCRIPTION OF THE PRIOR ART

The lining of process equipment with refractory material is often necessary when equipment is operated at elevated temperatures, for both vessel protection and energy conservation. Bricks have been used, but castable refractory concrete is more typically used. Chemical process vessels which operate at temperatures of about 1000° F. and higher are most often lined with refractory concrete to protect the vessel walls and conserve heat. Anchorage of the concrete lining to the vessel wall has been typically provided for support for the lining as well as for providing some measure of erosion resistance.

One type of anchors currently in use is an interlocking honeycomb hexagonal steel grid arrangement of anchors known in the art as "hexmesh". Since this type of anchor unit was interlocking, it was subject to possible catastrophic failure of a substantial wall portion. U.S. Pat. No. 3,076,481 related to another type of interlocking anchor system for refractory concrete liners for use in petroleum processing equipment.

An alternative to the grid anchor arrangement was known in the art as an "S bar" anchor, which had an inner attachment foot for welding to the vessel wall and an S-shaped top edge. A single opening was formed in the "S bar" anchor between the attachment foot and the S-shaped top edge for flow of the refractory concrete during pouring and to provide an interlocking mechanism between the refractory and the anchor. Each of the "Hexmesh" and "S bar" anchors exhibited resistance to forces which tended to pull the refractory lining from the vessel wall. However, pouring of the refractory during installation of the lining was difficult.

U.S Pat. Nos. 3,336,712 and 1,928,313 related to generally V-shaped or U-shaped refractory anchors or studs. These shapes of studs permitted relative ease of refractory pouring during installation. However, poured refractories were susceptible to forces tending to remove them from the vessel wall once installed. U.S. Pat. Nos. 2,340,176 and 3,564,799 related to shear reinforcing anchors for concrete structures used in building construction and the like. U.S. Pat. Nos. 3,587,198 and 3,077,058 related to anchors adapted for multi-layer types of insulation. U.S. Pat. No. 2,042,438 dealt with an anchor structure adapted primarily for building construction.

SUMMARY OF THE INVENTION

Briefly, the present invention relates to a new and improved support anchor for anchoring an erosion resistant refractory material to a processing vessel wall. The support anchor according to the present invention provides low flow resistance during refractory application while also providing high pull out resistance to forces once installed.

The refractory anchor of the present invention comprises a support body in the form of a flat center member extending between an outer edge near the vessel wall and an inner edge near the interior of the vessel. The center member of the support body is adapted to be mounted in a plane transverse the vessel wall, with end portions at each end extending transversely away therefrom in the plane transverse to the vessel wall. The support body has a plurality of feet extending from its outer edge for attachment of the support anchor to the vessel wall. The attachment feet are preferably spaced from each other to provide refractory flow space near the vessel wall. For further strength of attachment, a number of tabs are formed extending transversely from the support body. The tabs are formed by cutting and bending the tabs out away from the support body to provide apertures in the flat surfaces which serve as spaces or openings through which the refractory may flow during refractory application. The tabs are formed at portions of the support body intermediate the outer and inner edges to act as submerged anchors and provide additional strength and support for the refractory once hardened.

DESCRIPTION OF THE PREFERRED EMBODIMENT

Figure 1:
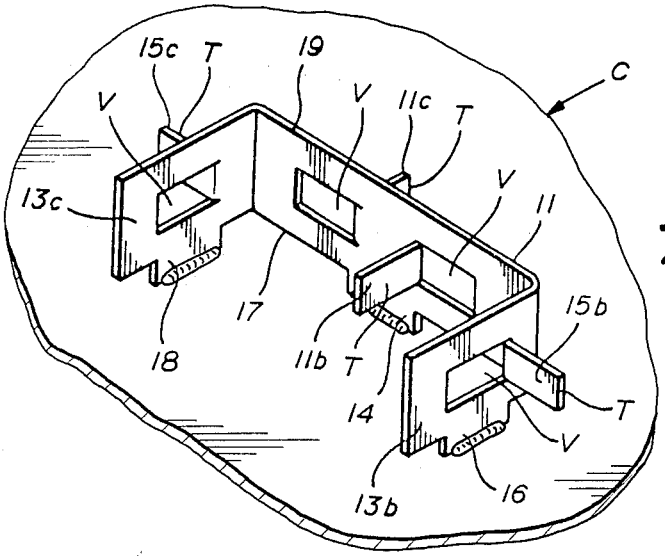
FIG. 1 is an isometric view of a first embodiment of the present invention attached to a vessel wall.

In the drawings, a first embodiment of the present invention takes the form of refractory anchor C (FIG. 1) for a castable or plastic refractory concrete. The anchor C has a flat center member 11 adapted to be mounted in a plane transverse to a wall of a conventional chemical processing unit. End portions **13*b* and 13*c* are integrally formed with and extend transversely from the center member 11. Anchor C is a single piece anchor with end protions 13*b* 13*c* and a center member formed from a single element. In the anchor C, the end portions 13*b* and 13*c* extend in the same direction from the center member 11, giving the anchor C a general "U-shaped" configuration. The proportions of the "U" shape are usually such that the center member 11 is longer than the end portions 13*b* and 13*c*. End portions 13*b* and 13*c* generally extend at substantially right angles from center member 11. Extending away from an outer edge 17 of the anchor C are attachment members in the form of attachment feet by which the anchor C is attached to an interior wall of the processing vessel by welding or the like. One foot 14 is formed on the center member 11, and one foot 16 and 18, is formed on each of end portions 13*b* and 13*c*, respectively. The attachment feet 14, 16 and 18 support anchor C at a spaced position away from the vessel wall in order to allow the flow of refractory material between the outer edge 17** of support anchor C and the vessel wall during refractory application, and to provide interlocking of the hardened refractory material with the anchor C.

Extending outwardly from the flat center member 11 and each end portion 13*b* and 13*c* are anchoring members or tabs T for providing anchoring support within the refractory material. Tabs T are integrally formed by punching out or making cuts in the flat surfaces 11, 13*b* and 13*c* of anchor C intermediate an inner edge 19, which is exposed to conditions within the interior of the vessel, and the outer edge 17 and bending the tabs at a suitable angle with the flat surfaces. Each of end portions 13*b* and 13*c* has a tab 15*b* and 15*c*, respectively extending away from the interior of the "U" shaped support anchor C. Center member 11 has two tabs 11*b* and 11*c* extending in opposite directions therefrom, with tab 11*b* extending inwardly and tab 11*c* extending outwardly from the "U" shape of anchor C. Openings or voids V are thus formed in the anchor C adjacent each of the tabs formed therein.

The tabs T and the voids V resulting from the formation of the tabs T allow the installed refractory material to flow through the anchor C during installation of the refractory material and cause interlocking of the hardened refractory material with the anchor C. Tabs T provide submerged support for the refractory material even at outside corners and noses due to the extension of tabs T beyond the anchor body.

Figure 2:
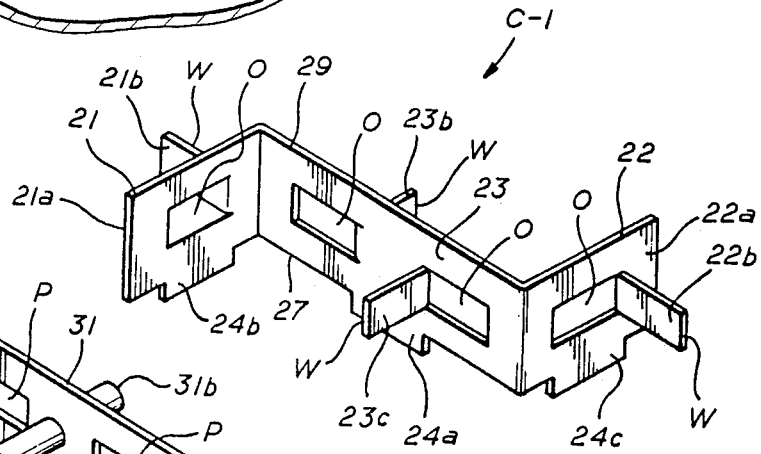
FIG. 2 is an isometric view of an alternate embodiment of the present invention.

In an alternate configuration C-1 (FIG. 2) of an anchor of the present invention, a generally "Z-shaped" configuration is formed from a single piece by having end portions 21 and 22 extend away at substantially right angles from a center member 23 in different directions. Extending from an outer edge 27 of anchor C-1 are attachment feet 24 for the anchor C-1 to be attached to a vessel wall by welding or the like. As in the anchor C, attachment feet 24 support anchor C-1 away from the vessel wall to provide a flow space adjacent the vessel wall for the installed refractory. One foot 24*a* is formed on center member 23, with one foot 24*b* also formed on end portion 21 and one foot 24*c* on end portion 22.

Extending on anchor C-1 from the flat surface of the end portions 21*a*, 22*a* and center member 23 are tabs W formed in a like manner to tabs T of anchor C. The tab 21*b* on end portion 21 extends outwardly away from, and in a plane substantially parallel with the plane of center member 23. Similarly the tab 22*b* on end portion 22 extends outwardly away from and in a plane substantially parallel with the plane of center member 23. Center member 23 has an upper tab 23*b* extending from center member 23 in the opposite direction from end portion 21 and a lower tab 23*c* extending from center member 23 in the opposite direction from end portion 22. The formation of tabs 21*b*, 22*b*, 23*b* and 23*c* result in openings O in the flat surfaces of anchor C-1 between outer edge 27 and inner edge 29, which allows the flow of installed refractory through the anchor C-1 and permits interlocking therebetween.

Figure 3:
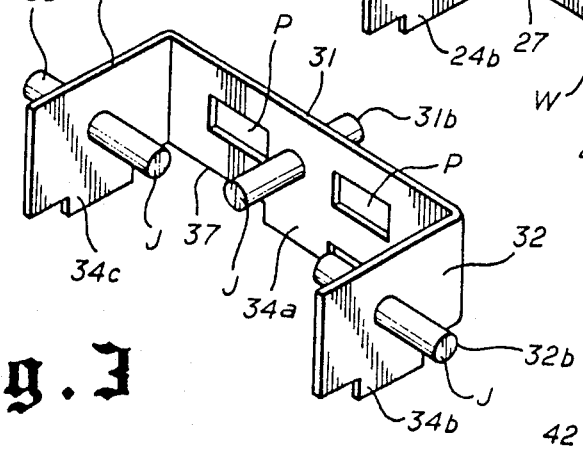
FIG. 3 is an isometric view of an alternate embodiment of the present invention.

In an alternate configuration C-2 (FIG. 3) of an anchor of the present invention, generally a "C-shaped" configuration, is formed from a singe piece by having end portions 32 and 33 extend away at substantially right angles from a center member 31 in the same direction. Extending from an outer edge 37 of anchor C-2 are attachment feet 34 for anchor C-2 to be attached to a vessel wall by welding or the like which support anchor C-2 away from the vessel wall as with anchor C. One foot 34*a* is formed on the center member 31, with one foot 34*b* also formed on the end portion 32 and one foot 34*c* on end portion 33.

Extending transversely out from the flat surfaces of the center member 31*b* and end portions 32*b* and 33*b* are rods J. Rod 31*b* extends transversly out from center member 31, rod 32*b* extends traversely out from end portion 32 and rod 33*b* extends traversely out from end portion 33. In center member 31 adjacent rod 31*b* are openings P which allow the flow of installed refractory material through the anchor C-2 and permits interlocking therebetween.

Figure 4:
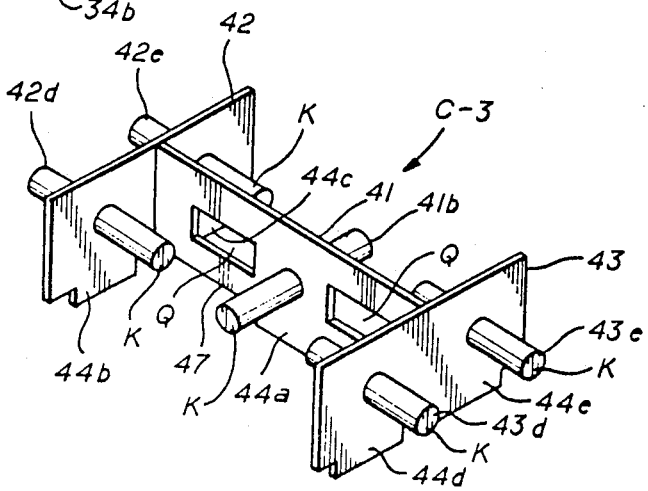
FIG. 4 is an isometric view of an alternate embodiment of the present invention.

In an other alternate configuration C-3 (FIG. 4) of an anchor of the present invention, a generally "I-shaped" configuration is formed as a single piece by welding or the like by having end portions 42 and 43 extend at substantially right angles from a center member 41 in two different directions. Extending from an outer edge 47 of anchor C-3 are attachment feet 44 for anchor C-3 to be attached to a vessel wall by welding or the like which support anchor C-3 away from the vessel wall as with anchor C. One foot 44*a* is formed on center member 41, with two feet 44*b* and 44*c* also formed on end portion 42 and two feet 44*d* and 44*e* on end portion 43.

Extending transversely out from the flat surfaces of center member 41, and end portions 42 and 43 are rods K. Rod 41*b* extends transversely out from center portion 41 in both directions. Extending transversely out from end portion 42 are two rods 42*d* and 42*e* on opposite sides of center member 41. End portion 43 has two rods 43*d* and 43*e* extending transversely therefrom on opposite sides of center member 41. Center member 41 has openings Q adjacent rod 41*b* which allows the flow of installed refractory material through the anchor C-3 and permits interlocking therebetween.

In the use of the support anchor of the present invention the anchor is welded to the interior of the vessel or pipe at the feet. In order to gain extra flexibility only the feet of the end portions may be welded to the vessel wall. The pattern or location of the anchor on the vessel wall can be any pattern or random as is well known in the art. A typical density is nine anchors per square foot for anchors having a center member length of four inches and a heigth of from one to one and one-half inches.

The refractory material is poured or applied to the vessel wall submerging the support anchor and surrounding the tabs or rods and flowing through the openings. Preferably the refractory material depth is such that the inner edges 19 of the anchors are flush with the surface of the refractory material in order to provide resistance to surface erosion.

Thus the support anchors of the present invention provide individual support anchors which decrease the possibility of catastrophic failure while providing increased interlocking of the refractory material with the support anchors and increased submerged support for the refractory material.

The foregoing configurations are only exemplary of the combinations of anchor body shapes and anchor member shapes which are defined in the claims. It should be understood that the foregoing description and drawings of the invention are not intended to be limiting, but are only exemplary of the inventive features which are defined in the claims.

What is claimed is:

1. A support anchor system for anchoring a castable or plastic refractory material to a processing vessel, comprising:

(a) an array of a plurality of individual support bodies, each body located adjacent other bodies and unconnected to the adjacent bodies when installed in the processing vessel, each body formed of one piece and comprising:

(1) a flat center member portion for positioning in a plane transverse to the vessel wall between an outer edge near the vessel and an inner edge away from the vessel; and (2) end portions formed with and extending transversely with respect to each end of said central member, each end portion extending in a same direction from said center member in a plane transverse to the vessel wall;

(b) a plurality of attachment means extending from the outer edge of each of said support bodies for individually attaching each of said support bodies to the vessel wall at a space position therefrom;

(c) a plurality of openings in each of said support bodies to allow flow of refractory material through said support bodies during installation of refractory material to at least partially bond therewith; and (d) a plurality of anchoring means extending transversely from each of said support bodies between the inner and outer edges of said support bodies for providing submerged anchoring support within the installed refractory material.

2. The support anchor system of claim 1, wherein each of said plurality of attachment means comprises an attachment foot extending from said outer edge of each of said support bodies so as to support said bodies at a spaced position from the vessel wall.

3. The support anchor system of claim 1, wherein each of said attachment means comprises an attachment foot extending from a portion of said outer edge of each of said support bodies so as to support said bodies at a spaced position from the vessel wall.

4. The support anchor systems of claim 3, wherein said anchoring means comprises unitarily formed portions of said support bodies bent outwardly transversely with respect to said support bodies adjacent said openings.

5. The support anchor system of claim 3, wherein said anchoring means comprises integral rods extending transversely through surfaces of said support bodies.

6. The support anchor system of claim 3, wherein said anchoring means comprises tabs extending transversely from surfaces of said support bodies.

7. The support anchor system of claim 1, wherein: at least one of said openings is formed in each of said central members of said support bodies.

8. The support anchor system of claim 1, wherein: at least one of said openings is formed in each of said end portions of said support bodies.

9. The support of anchor system of claim 1, wherein: each said end portions extend in two different directions from said center member.

* * * * *